US006449881B1

(12) United States Patent
Assaf et al.

(10) Patent No.: US 6,449,881 B1
(45) Date of Patent: Sep. 17, 2002

(54) DETACHABLE SHOE WALLET

(76) Inventors: Nadia Assaf, 3000 Granada St. #9, Ft. Lauderdale, FL (US) 33304; Van A. Evans, 261 NE. 38th St., D115, Ft. Lauderdale, FL (US) 33334

( * ) Notice: Subject to any disclaimer, the term of this patent is extended or adjusted under 35 U.S.C. 154(b) by 0 days.

(21) Appl. No.: 09/974,795

(22) Filed: Oct. 12, 2001

(51) Int. Cl.[7] ..... A43B 5/00; A45C 1/06; A45C 11/18

(52) U.S. Cl. ..... 36/136; 36/132; 150/143; 150/144; 150/149

(58) Field of Search ..... 224/222, 267; 36/132, 136; 150/147, 149, 136, 143, 144

(56) References Cited

U.S. PATENT DOCUMENTS 2,557,836 A * 6/1951 Mueller ..... 150/136
2,629,251 A * 2/1953 Schwalberg ..... 150/143
2,777,494 A * 1/1957 Anderson ..... 150/143
3,427,020 A * 2/1969 Montour et al. ..... 36/132
3,757,840 A * 9/1973 Herbener ..... 150/143
4,286,639 A * 9/1981 Murphy ..... 150/149
4,507,882 A * 4/1985 Harrell ..... 36/136
4,536,975 A * 8/1985 Harrell ..... 36/136
4,966,210 A * 10/1990 Folkertsma ..... 150/147
5,311,679 A * 5/1994 Birch, Sr. ..... 36/136
5,636,742 A * 6/1997 Hoffrichter ..... 150/149
5,778,954 A * 7/1998 Sullivan et al. ..... 150/143
5,988,467 A * 11/1999 Brustein ..... 224/222

* cited by examiner

*Primary Examiner*—Anthony D. Stashick
(74) *Attorney, Agent, or Firm*—Dennison, Schultz & Dougherty

(57) ABSTRACT

A detachable shoe wallet comprises a generally flat elongated body which is adapted to be folded over upon itself. The wallet is made of a double layer of nylon material and includes an inner pocket with a separate closure for securing small articles. The wallet also includes a plurality of longitudinally and laterally spaced eyelets for maintaining the wallet on the instep of a shoe.

12 Claims, 3 Drawing Sheets

DETACHABLE SHOE WALLET

FIELD OF THE INVENTION

This invention relates to a detachable shoe wallet and more particularly to a wallet for attachment to a pair of athletic shoes for securely holding small articles such as keys and cash.

BACKGROUND FOR THE INVENTION

A common problem encountered by participants in athletics such as running is what to do with keys, cash and the like while engaging in such activities. For runners, particularly those who participate in longer events, the use of a wallet and pocket in a running outfit is unacceptable.

For this and other reasons, there have been several attempts to develop a satisfactory detachable shoe-pocket system.

For example, the U.S. Patent of Harrell U.S. Pat. No. 4,507,882 discloses a quick-attached shoe accessory in the form of a container for carrying rings, money and like items on the instep of an athletic or other type shoe. As disclosed therein, the accessory has a sheath-like body with an open top end with a covering flap, closed bottom and pleated sides. The accessory is secured to a shoe by a tongue attached to the bottom, passing beneath the shoe laced portions and terminating at the top. A pair of shoe lace holes in an upward extension of the body is provided so that shoe laces may be passed through the shoe lace holes and tied holding the container on the top of the instep.

A more recent development of a flexible shoe pocket is disclosed in the U.S. Pat. No. 5,094,016 of DiVito. The DiVito patent discloses an improved shoe pocket in which the pocket is formed between front and back faces of a sheet material. The pocket includes a flap portion for closing the pocket and which is easily opened upon application of digital pull apart forces. The pocket is mounted to the shoe by means of two pair of eyelets which permit the passage of a shoe lace therethrough. An additional double width eyelet in the back portion of the pocket permits the laces to continue to be threaded on the shoe side flaps and secured in a knot well above the pocket top flap without interfering therewith.

It appears that neither or the aforementioned pockets have enjoyed widespread commercial success. Accordingly, it is presently believed that there is a relatively large market and a demand for an improved shoe wallet in accordance with the present invention. It is believed that there will be a demand for the improved wallet in accordance with the present invention because such wallets are relatively secure, more resistant to water, particularly to rain, and present a pleasing appearance.

In addition, the shoe wallets in accordance with the present invention are easy to use, durable and can be manufactured and sold at a competitive price. Such wallets also provide a relatively thin, flat profile and may be produced in various colors and with various designs on the outer surface thereof.

BRIEF SUMMARY OF THE INVENTION

In essence, the present invention contemplates a detachable shoe pocket or wallet for attachment to an athletic shoe or the like. The detachable wallet comprises a generally flat elongated body having opposite ends and first and second portions between the opposite ends. The first and second portions are adapted to be folded over one upon the other in the same manner as conventional wallets. The detachable wallets also include an inner pocket or sheath which is adapted to receive one or more keys, currency, driver's license, or the like. The inner pocket or sheath includes an outer cover with a closed bottom adjacent to one end of the elongated body, two sides and an open top. This pocket is fixed to a first of the adjacent portions and includes an expandable closure (a gusset) between the cover and each of the sides. The expandable closure is attached to the first portion of the wallet so that the top of the cover can be separated from the first portion to thereby form a pouch.

An elongated inner layer is superimposed on the second portion of the body and fixed thereto. This inner layer includes a flap having inner and outer surfaces and extends over the open top of the pocket for closing the pocket. A hook and loop releasable fastener such as a Velcro fastener includes two mating elements and is provided for closing the pocket. For example, a first of the two mating elements is fixed to the inside surface of the flap while the second mating element is fixed to an outside surface of the cover in a position that will be engaged by the first mating element when the cover is closed.

The detachable shoe wallet also includes mounting means including a plurality of longitudinally and laterally spaced eyelets which pass through the second portion of the body and the inner layer. The positioning of the eyelets are in general alignment with the eyelets of an athletic shoe so that the wallet is readily laced to the shoe using the laces of the shoe.

A second hook and loop releasable fastener includes two mating members with a first of the members fixed to the outer cover at the bottom thereof and the other of the mating members fixed to an inner surface at the far end of the second portion of the elongated body for engagement by the first element. Thus, when the wallet is folded over upon itself, the wallet is held in closed position by the releasable fastener with the flap completely covered by the two portions of the wallet.

The invention will now be described in connection with the accompanying drawings wherein like reference numeral have been used to indicate like parts.

DESCRIPTION OF THE PREFERRED EMBODIMENT OF THE INVENTION

A detachable shoe wallet in accordance with a preferred embodiment of the present invention will now be described in connection with FIGS. 1–6. As illustrated therein, a detachable shoe wallet 10 has a flat elongated body 12 which preferably has a generally rectangular shape. In the preferred embodiment of the invention, the elongated body is about 7½ inches by 2¾ inches and when folded over upon itself has a thickness of about ¼ inch. The elongated body 12 is preferably made of polyester or other durable material which is water resistant if not impervious to water. The elongated body 12 is adapted to be folded over upon itself in the same manner as a conventional billfold.

Figure 1:
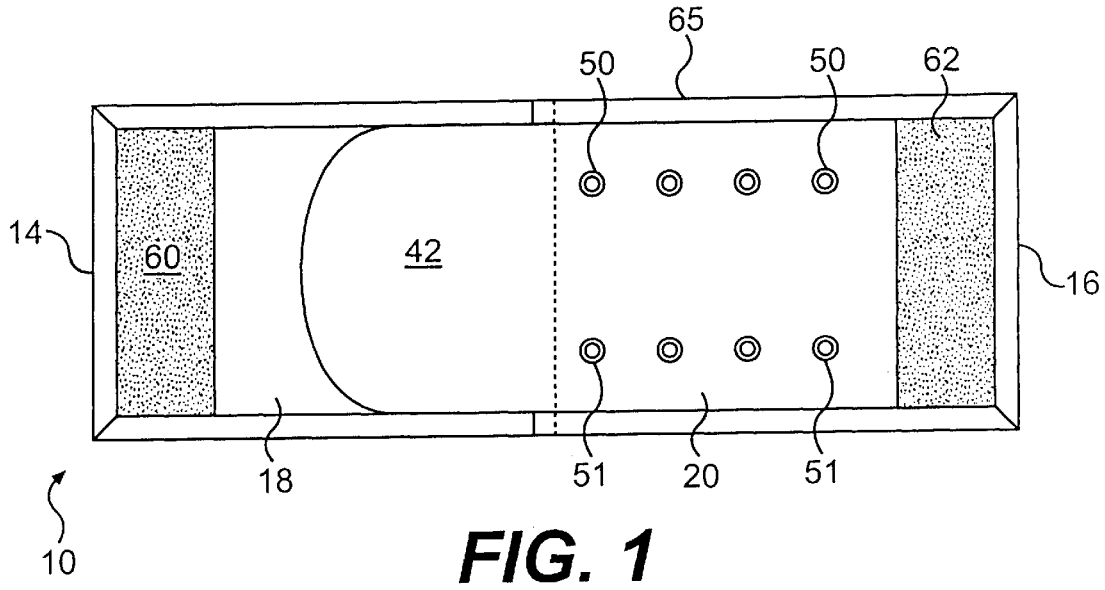
FIG. 1 is a top or plan view of a shoe wallet in accordance with the present invention wherein a first flap for closing the pocket is shown in its closed position.
Figure 1A:
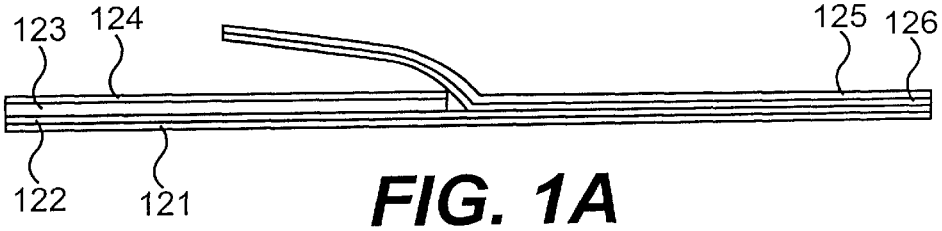
FIG. 1A is a schematic illustration which shows the multi layer construction of one embodiment of the invention.
Figure 2:
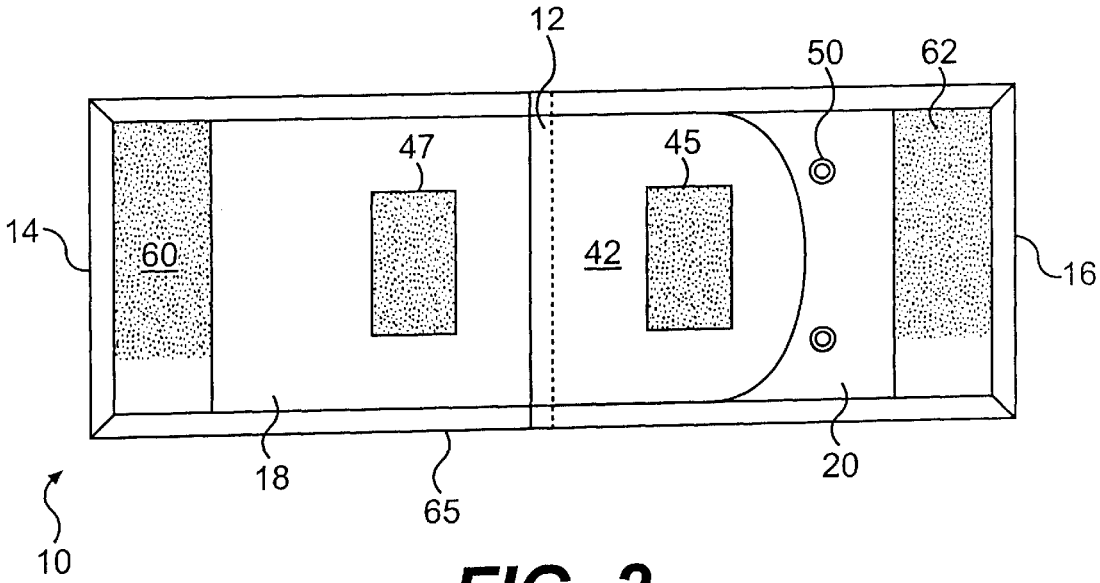
FIG. 2 is a top or plan view of the shoe wallet shown in FIG. 1, but with the flap in an open position.
Figure 4:
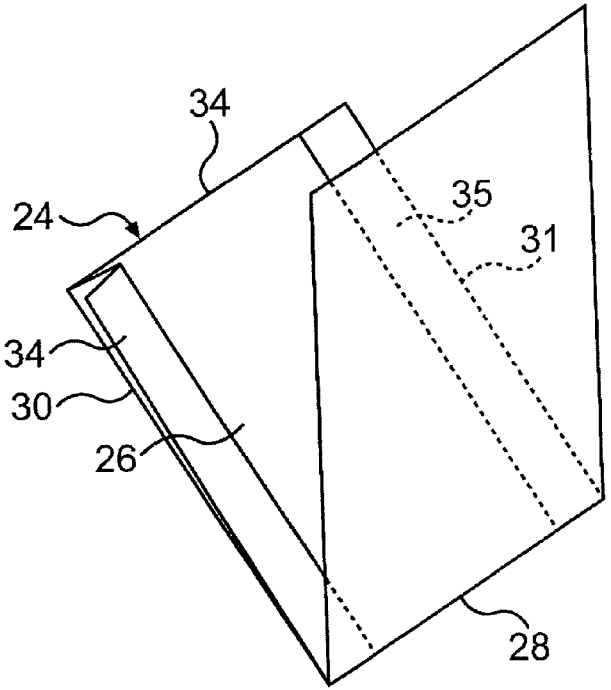
FIG. 4 shows a sheath including expandable closures which are incorporated in a shoe wallet in accordance with the present invention.
Figure 3:
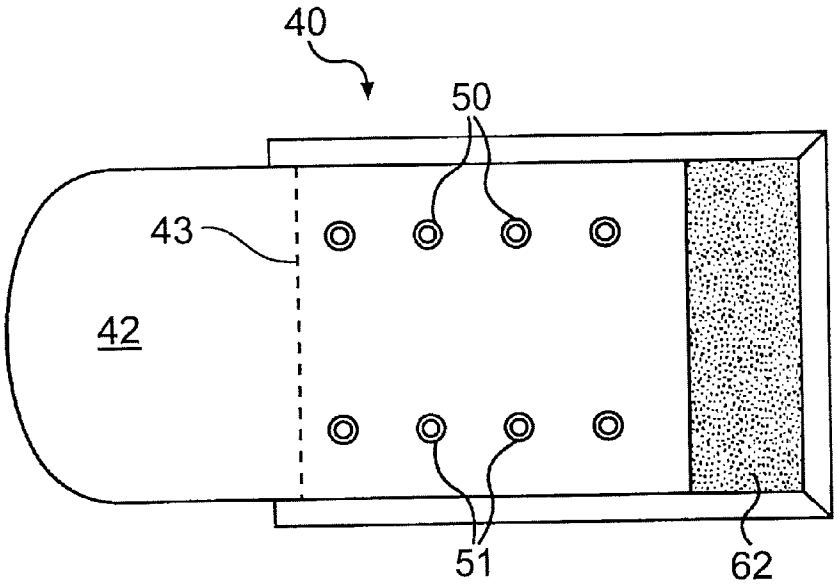
FIG. 3 is a top or plan view of an inner layer for use in a shoe wallet in accordance with the present invention.
Figure 5:
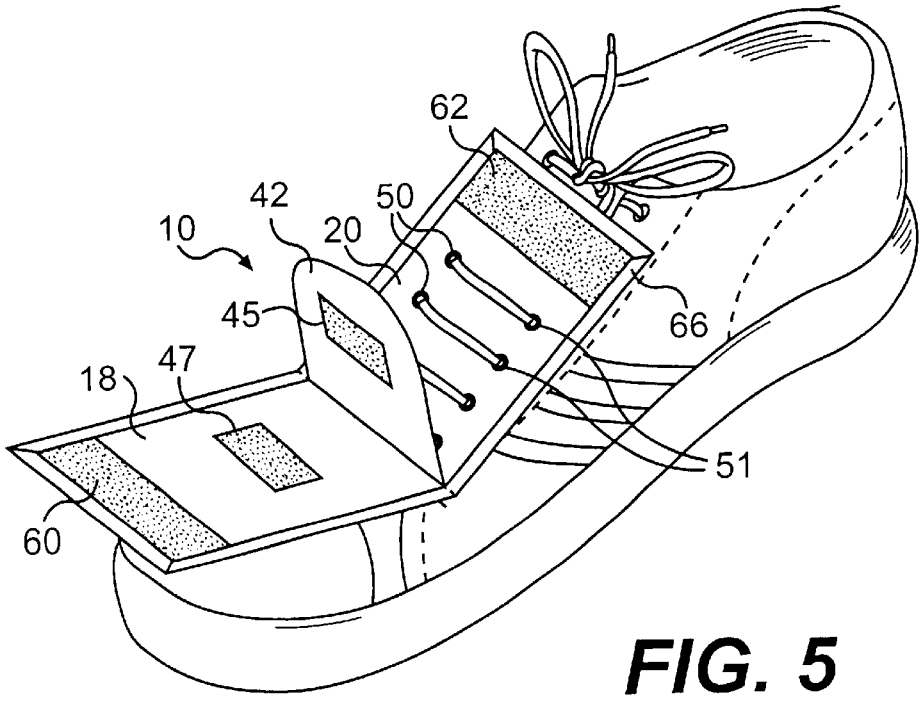
FIG. 5 is a perspective view illustrating a shoe wallet according to the present invention as attached to a shoe and wherein the wallet is in its opened position.
Figure 6:
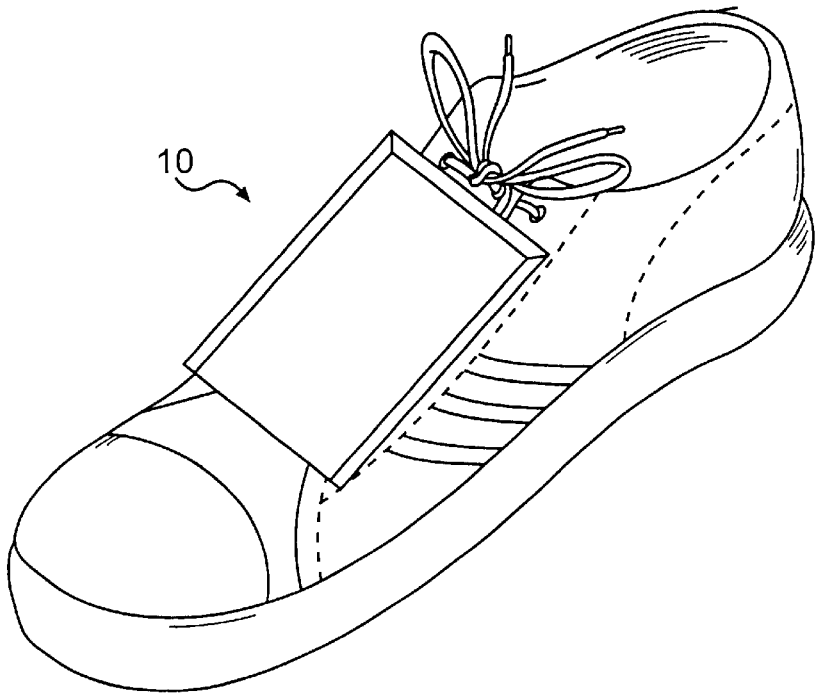
FIG. 6 is a perspective view illustrating the shoe wallet according to the present invention as attached to a shoe and with the wallet in its closed position.

The use of a double layer of nylon, polyester or other durable cloth as illustrated in FIG. 1A is preferred in order to provide a very thin or flat profile with sufficient stiffness to approximate a more conventional billfold. This double layer may be fused together in a conventional manner to form a more rigid structure.

The elongated body 12 includes a pair of opposite ends 14 and 16 and first and second portions 18 and 20 between the opposite ends 14 and 16. These portions 18 and 20 refer to those portions of the elongated body 12 which are on opposite sides of a fold line or center line about which the wallet is folded over upon itself. The detachable wallet also includes an expandable inner pocket or sheath 24 which is adapted to receive currency, coins, keys or the like. This pocket is relatively compact but will accommodate one or two keys, a small amount of change, paper currency, a driver's license and the like.

The inner pocket or sheath 24 includes an outer cover 26 which is preferably made up of a double layer of material. In addition, the inner pocket has a closed bottom end edge 28 which is adjacent to one end 14 of the elongated body 12. The sheath 24 also includes two expandable sides 30 and 31 and an open top 34. This sheath or pocket is fixed or stitched to the first portion 18 of the elongated body 12 along the end 14. Each of the expandable sides 30 and 31 include a pleated closure 34, 35 which are preferably made of the same nylon material as the elongated body 12. These pleated closures 34 and 35 are stitched to the outer cover 26 and first portion 18 with the pleat therebetween.

An elongated inner layer 40 having a generally rectangular shape with a flap 42 extending outwardly from one end of the rectangular shaped layer 40 is stitched to the second portion 20 of the elongated body 12. This inner layer including the flap 42 is also preferably made of a double layer of nylon material and is essentially the same size (without the flap) as the second portion 20 and superimposed thereon and stitched or otherwise fixed in place with the flap 42 extending over the open top 34 of the sheath 24. In the preferred embodiment of the invention, the inner layer 40 is also stitched to elongated body 12 at or along the top of the flap 42 by a line of stitches 43. These stitches are preferably along a center line or fold line of the wallet and separate the first and second portions 18 and 20.

As illustrated in FIG. 1A, the elongated body 12 including first and second portions 18 and 20 are made up of a double layer that is two layers 121 and 122. As also shown, the inner pocket or sheath is also constructed of a double layer 123 and 124 as is the inner layer 40. The inner layer 40 is preferably constructed of two layers 125 and 126. These layers may be fused together by the application of heat and pressure or by an adhesive bond.

A Velcro fastener or other hook and loop fastener 45 is fixed to an inner surface of the flap 42 (FIG. 2) i.e. the side which faces the outer surface of the cover 26. The outer surface of the cover 26 also includes a hook and loop fastener 47 (FIG. 2) which mates with the fastener 45 to fasten the flap in place to thereby close the open top 34 of the cover 26. In the preferred embodiment of the invention, each of the elements or members of the hook and loop fasteners have a generally rectangular shape and are about 1 inch by ¾ inch to provide a secure closure. It is important to provide a fastener of sufficient size that will remain closed notwithstanding the pounding of a shoe during an athletic event and at the same time which can be opened with a reasonable amount of force applied by an individual's fingers.

The detachable shoe wallet may also include a mounting means such a pair of elongated strips of Velcro fastener for engaging similar strips on an athletic shoe. However, in the preferred embodiment of the invention the mounting means includes a plurality of longitudinally and laterally spaced eyelets 51 which are arranged in two rows. The two rows are in general alignment with the eyelets of an athletic shoe so that the wallet is readily laced to the shoe using the laces of the shoe to hold the wallet securely thereon. The eyelets 50 and 51 pass through the second portion 20 of the elongated body and the inner layer 40.

A second pair of hook and loop fastener elements 60 and 62 are fixed near the opposite ends 14 and 16 of the elongated body 12 for engagement with one another when the wallet 10 is folded over into a closed position. When the wallet 10 is folded over at the fold line, the element 60 engages the element 62 to securely close the wallet 10. For example, the element 60 is fixed to an inner surface of the first portion 18 while the element 62 is fixed to the inner layer 40. In this way, the pocket 34 is closed first by the flap 42 and second by the first and second portions 18 and 20 which are held in place by the fastener elements 60 and 62. This double closure tends to protect the materials in the pocket from rain and provides a warning if the first and second portions open or separate during an athletic pursuit. For example, the separation of the two portions will alert the runner that the wallet is partially opened and should be reattached to prevent the inner flap from opening.

In a preferred embodiment of the invention, the elongated body 12 and inner layer 40 which is superimposed on the second portion 20 have a reinforcing strip 65 extending around the outer periphery and stitched thereto. In addition, the two sides and bottom of the outer cover 26 include a reinforcing strip 66 around their edges. Further, in the preferred embodiment of the invention, the outer cover is a separate piece which is stitched to the elongated body 12.

It is presently believed that the double layers of nylon or other durable material combined with an inner flap and double closure results in a more desirable product with more desirable stiffness. This combination also results in a wallet that can be readily removed from the shoe and is sufficiently compact to be carried in a pocket or a purse. Further, the double layer of nylon material is such as to be water retardant if not water resistant so that articles carried in the pocket will remain dry even in those cases where a runner is running in the rain or through puddles.

While the invention has been described in connection with its preferred embodiment, it should be recognized that changes and modifications may be made therein without departing from the scope of the appended claims.

What is claimed is:

1. A detachable shoe wallet comprising an elongated body having opposite ends and first and second adjacent portions extending between said opposite ends and said elongated body adapted to be folded over with one of said adjacent portions on top of the other of said adjacent portions, a sheath including an outer cover with a closed bottom, two sides and an open top fixed to a first of said adjacent portions with said bottom of said sheath adjacent to one of said opposite ends and each of said sides including an expandable closure between said cover and said first portion to allow said sheath to receive an article therein; an inner layer fixed to said second portion of said body and including a flap with inner and outer surfaces extending over said open top of said sheath for closing said sheath, a first hook and loop releasable fastener including two mating elements with one of said elements fixed to said flap member on an inner surface thereof and said second of said elements fixed to said outer cover for engagement with said first element; mounting means including a plurality of longitudinally and laterally spaced eyelets passing through said second portion of said body and said inner layer for maintaining said wallet on an instep of a shoe above the tongue of the shoe and adapted to receive the passage of two shoelace ends therethrough to thereby secure said pocket to the shoe by being laced thereto; a second hook and loop releasable fastener including two mating elements with a first of said elements of said second releasable fastener fixed to said outer cover at the bottom thereof and the other of said elements of said second releasable fastener fixed to an inner surface of said second portion of said elongated body for engagement by said first element of said second releasable fastener when said body is folded over upon itself whereby said shoe pocket is closed with a security cover over the closed flap.

2. A detachable shoe wallet according to claim 1 which includes a reinforcing strip extending around the periphery of the elongated body.

3. A detachable shoe wallet according to claim 2 which includes a transverse row of stitches between said first and second portion of said elongated body in a fold area and wherein said transverse row of stitches secures said flap to said elongated body.

4. A detachable shoe wallet according to claim 2 wherein said expandable closure comprises a pleated element and a reinforcing strip between said pleated element and said outer cover and in which an opposite portion of said pleated cover is disposed between said elongated body and said reinforcing strip.

5. A detachable shoe wallet according to claim 3 in which said wallet is made of nylon sheet material.

6. A detachable shoe wallet according to claim 5 in which said wallet is made of a double layer of nylon sheet material.

7. A detachable shoe wallet according to claim 5 which includes four pair of eyelets constructed and arranged to be in general alignment with the eyelets in an athletic shoe.

8. A detachable shoe wallet according to claim 3 in which each of said elongated body and said inner layer include a double layer of nylon with one of said layers superimposed on the other of said layers.

9. A detachable shoe wallet according to claim 8 in which said flap includes a double layer of nylon with one of said layers superimposed on the other and with stitching along the periphery of the flap to thereby hold the two layers together.

10. A detachable shoe wallet according to claim 9 in which said elongated body has an outer reinforcing strip stitched to its outer peripheral edge.

11. A detachable shoe wallet according to claim 9 in which said outer cover of said pocket includes a reinforcing strip around its bottom and side edges.

12. A detachable shoe wallet comprising an elongated body having opposite ends and first and second adjacent portions extending between said opposite ends and said elongated body adapted to be folded over with one of said adjacent portions on top of the other of said adjacent portions, a sheath including an outer cover with a closed bottom, two sides and an open top fixed to a first of said adjacent portions with said bottom of said sheath adjacent to one of said opposite ends and each of said sides including an expandable closure between said cover and said first portion to allow said sheath to receive an article therein; an inner layer fixed to said second portion of said body and including a flap with inner and outer surfaces extending over said open top of said sheath for closing said sheath, a first hook and loop releasable fastener including two mating elements with one of said elements fixed to said flap member on an inner surface thereof and said second of said elements fixed to said outer cover for engagement with said first element; mounting means for maintaining said wallet on an instep of a shoe above the tongue of the shoe; a second hook and loop releasable fastener including two mating elements with a first of said elements of said second releasable fastener fixed to said outer cover at the bottom thereof and the other of said elements of said second releasable fastener fixed to an inner surface of said second portion of said elongated body for engagement by said first element of said second releasable fastener when said body is folded over upon itself whereby said shoe pocket is closed with a security cover over the closed flap.

* * * * *